US006033277A

United States Patent [19]

Kaihara

[11] Patent Number: 6,033,277

[45] Date of Patent: Mar. 7, 2000

[54] METHOD FOR FORMING A FIELD EMISSION COLD CATHODE

[75] Inventor: Toshio Kaihara, Shiga, Japan

[73] Assignee: NEC Corporation, Tokyo, Japan

[21] Appl. No.: 09/086,744

[22] Filed: May 29, 1998

Related U.S. Application Data

[63] Continuation-in-part of application No. 08/599,126, Feb. 9, 1996, abandoned.

[30] Foreign Application Priority Data

Feb. 13, 1995 [JP] Japan ..... 7-23582

[51] Int. Cl.[7] ..... H01J 9/00; H01J 9/04

[52] U.S. Cl. ..... 445/24; 445/50

[58] Field of Search ..... 445/50, 49, 24

[56] References Cited

U.S. PATENT DOCUMENTS

| | | |
|---|---|---|
| 3,921,022 | 11/1975 | Levine . |
| 4,690,744 | 9/1987 | Naoe et al. . |
| 4,855,636 | 8/1989 | Busta et al. . |
| 4,874,497 | 10/1989 | Matsuoka et al. . |
| 4,929,321 | 5/1990 | Buhl . |
| 4,931,307 | 6/1990 | Sugita et al. . |
| 5,201,992 | 4/1993 | Marcus et al. . |
| 5,250,779 | 10/1993 | Kaufmann et al. . |
| 5,302,266 | 4/1994 | Grabarz et al. . |
| 5,316,511 | 5/1994 | Lee . |
| 5,389,026 | 2/1995 | Fukuta et al. . |
| 5,435,900 | 7/1995 | Gorokhovsky . |

FOREIGN PATENT DOCUMENTS

| | | |
|---|---|---|
| 0 360 994 | 4/1990 | European Pat. Off. . |
| 0 483 814 | 5/1992 | European Pat. Off. . |
| 0 508 737 | 10/1992 | European Pat. Off. . |
| 2 700 222 | 7/1994 | France . |
| 2 228 268 | 8/1990 | United Kingdom . |

OTHER PUBLICATIONS

Y. Choi et al., "16Mbit Synchronous DRAM with 125Mbytes/sec Data Rate", 1993 Symposium on VLSI Circuits, May 1993, pp. 65–66.

S. Gowni et al., "A 9NS 32K X 9, BICMOS TTL Synchronous Cache Ram with Burst Mode Access", Proceedings of the IEEE 1992 Custom Integrated Circuits Conference, May 3–6, 1992, pp. 781–784.

*Primary Examiner*—Patrick Ryan
*Assistant Examiner*—Kiley Stoner
*Attorney, Agent, or Firm*—Young & Thompson

[57] ABSTRACT

The present invention provides a method for reshaping up a cone-like electrode which is made of a refractory metal containing silicon. The method comprises the following steps. A surface of the cone-like electrode is subjected to an oxidation of silicon which is contained in the refractory metal. The oxidation is generated at rates which increase toward a top portion of the cone-like electrode. As a result, a silicon oxide film is formed, which coats the cone-like electrode. The silicon oxide film has thickness which gradually increase toward a bottom portion of the cone-like electrode. An interface between the silicon oxide film and the cone-like electrode has sloped angles which increase toward the top portion. The silicon oxide film is removed to thereby expose a reshaped cone electrode which has a sharply pointed top. The reshaped cone electrode has a surface having sloped angles which increase toward the sharply pointed top.

12 Claims, 3 Drawing Sheets

METHOD FOR FORMING A FIELD EMISSION COLD CATHODE

This application is a continuation-in-part of Ser. No. 08/599,126 filed Feb. 9, 1996 now abandoned.

BACKGROUND OF THE INVENTION

The invention relates to a method for forming a field emission cold cathode, and more particularly to a method for forming a cone-shaped field emission cold cathode having a top which is sharply pointed for improvements of emission properties.

Normally, a field emission electron gun 10 has a structure as illustrated in FIG. 1. The field emission electron gun 10 has a plurality of cone-shaped field emission cold cathodes 12 which are formed on a single silicon substrate 11. Each the cone-shaped field emission cold cathodes 12 is made of a refractory metal such as tungsten, molybdenum, tantalum and niobium. An insulation film 13 made of silicon oxide is formed on the silicon substrate 11. The insulation film 14 has a plurality of cavities 13, each of which accommodates each of the cone-shaped field emission cold cathodes 12. Gate electrodes 15 made of a refractory metal such as tungsten, molybdenum, tantalum and niobium are formed on the insulation film 14. The gate electrodes 15 have the same level as the top of each of the cone-shaped field emission cold cathodes 12. The gate electrode 15 encompasses and is separated from the top portion of each the cone-shaped field emission cold cathode 12.

A bias is applied at a few voltages between the gate electrode 15 and the cone-shaped field emission cold cathode 12 so as to cause electron emission from the top of each the cone-shaped field emission cold cathodes 12 without heating the cathodes 12.

A conventional method for forming a cone-shaped field emission cold cathode of Spindt type will be described with reference to FIGS. 2A through 2E. As illustrated in FIG. 2A, a silicon oxide film 14A having a thickness of 1 micrometers is formed on a silicon substrate 11 by a chemical vapor deposition. A gate layer 15A is deposited on the silicon oxide film 14A. The gate layer 15A has a thickness of 0.4 micrometers and is made of a refractory metal such as tungsten, molybdenum, tantalum and niobium. A photo-resist film 16 is applied on the gate layer 15A.

As illustrated in FIG. 2B, holes 16*a* having a diameter of 1 micrometer are found in the photo-resist film 16 at a pitch of 10 micrometers. The gate layer 15A and the silicon oxide film 14A are selectively etched using the photo-resist film 16 to thereby form an insulator 14 having a cavity 13 and a gate electrode 15. The photo-resist film 16 used is then removed.

As illustrated in FIG. 2C, the silicon substrate 11 is rotated in a plane parallel to the surface of the silicon substrate 11. Aluminum atoms are deposited at an angle of approximately 15 degrees to the surface of the silicon substrate 11 to form an aluminum film 17 having a thickness of 0.15 micrometers. The aluminum film 17 extends toward the center of the cavity 13 to make the opening 15*a* of the gate 15 narrow.

As illustrated in FIG. 2D, refractory metal atoms such as tungsten, molybdenum, tantalum and niobium are deposited in a vertical direction to the surface of the silicon substrate 11 whereby a refractory metal cone 12 is formed in the cavity 13 and further a refractory metal layer 18 is deposited on the aluminum film 17. The refractory metal layer 18 has a concave portion being cone-shaped and posited over the opening 15*a*.

As illustrated in FIG. 2E, the refractory metal layer 18 and the aluminum film 17 are removed to expose the gate electrode 15 on the silicon oxide film 14 and the refractory metal cone 12 within the cavity 13. The refractory metal cone 12 serves as a cone-shaped cathode.

According to the above conventional method, the cone 12 is formed by the vertical deposition of refractory metal atoms while the aluminum film 17 is formed by the deposition of aluminum at the oblique angle. The deposition at the oblique angle of aluminum on the gate electrode 15 tends to cause a small variation in the shape and the position of the opening edge of the aluminum film 17. The shape of the cone 12, however, depends upon the shape and the position of the opening edge of the aluminum film 17. Any small variation in the shape or the position of the opening edge of the aluminum film 17 results in a considerable variation in the shape of the cone 12, particularly the top shape thereof. For the emission properties, the top shape of the cone 12 serving as the cathode is extremely influential. Any slight deformation of the top of the cone 12 results in a considerable deterioration of the electron emission properties. This may result in a reduction in the yield of the field emission electron gun having the cone-shaped field emission cold cathode. In order to obtain stable and desirable electron emission properties, it would be essentially to form a field emission cold cathode having a top sharply pointed without any deformation. For this reason, if the above conventional method is used for forming the field emission cold cathode, then it is difficult to obtain the desired top shape which is pointed without any deformation.

There is another method for forming a field emission cold cathode of Gray type which is disclosed in the U.S. Pat. Nos. 4,307,507 and 4,513,308. A silicon oxide film is formed on a silicon substrate and then pattered to thereby form a silicon oxide pattern on the silicon substrate. The silicon substrate is then subjected to an anisotrophy etching by using the silicon oxide pattern as a mask to form a cone on the silicon substrate. A surface of the cone is subjected to both oxidation and subsequent lift-off using a fluorine acid to thereby form a sharply pointed top of the cone which serves as a field emission cold cathode.

As described above, the oxide film which coats the refractory metal cone is selectively etched using the lift-off process using a fluorine acid so that the top portion of the refractory cone is exposed. If the lift-off process is used with a fluorine acid to selectively remove the oxide film covering the top of the cone then the top of the refractory metal cone is likely deformed from the desirable top shape which is sharply pointed. Any small variation in the shape or the position of the opening edge of the aluminum film 17 results in a considerable variation in the shape of the cone 12, particularly the top shape thereof. For the emission properties, the top shape of the cone 12 serving as a cathode is extremely influential. Any slight deformation of the top of the cone results in a considerable deterioration of the electron emission properties. This may result in a reduction in the yield of the field emission electron gun having the cone-shaped field emission cold cathode. In order to obtain stable and desirable electron emission properties, it would be essential to form a field emission cold cathode having a top sharply pointed without any deformation. For this reason, if the above conventional method is used for forming the field emission cold cathode, then it is difficult to obtain the desired top shape which is pointed without any deformation.

SUMMARY OF THE INVENTION

Accordingly, it is an object of the present invention to provide a novel method for forming a field emission cold cathode having a top sharply pointed without any deformation.

It is a further object of the present invention to provide a novel method for forming a field emission cold cathode having a top sharply pointed at a high yield.

The above and other objects, features and advantages of the present invention will be apparent from the following descriptions.

The present invention provides a method for reshaping up a cone-like electrode which is made of a refractory metal containing silicon. The method comprises the following steps. A surface of the cone-like electrode is subjected to an oxidation of silicon which is contained in the refractory metal. The oxidation is generated at rates which increase toward a top portion of the cone-like electrode. As a result, a silicon oxide film is formed, which coats the cone-like electrode. The silicon oxide film has thickness which gradually increases toward a bottom portion of the cone-like electrode. An interface between the silicon oxide film and the cone-like electrode has sloped angles which increase toward the top portion. The silicon oxide film is removed to thereby expose a reshaped cone electrode which has a sharply pointed top. The reshaped cone electrode has a surface having sloped angles which increase toward the sharply pointed top.

The present invention provides a method for forming a cone-shaped field emission cold cathode on a substrate. The method comprises the following steps. A silicon oxide layer is deposited by a chemical vapor deposition on the substrate. A gate layer made of a refractory metal is deposited on the silicon oxide layer. A photo-resist pattern is provided on the gate layer. The gate layer and the silicon oxide layer are selectively etched by using the photo-resist pattern as a mask to form a cavity having an opening. A metal material is deposited on the gate layer during which the substrate rotates in a plane parallel to a surface of the substrate at a predetermined oblique angle to the plane to thereby form a metal film having an opening edge which extends toward a center of the opening from an edge of the gate layer. A silicon containing refractory metal material containing silicon is deposited on the metal film and within the cavity in a vertical direction to a surface of the substrate to thereby form a silicon containing refractory metal cone in the cavity and further to form a refractory metal layer on the metal film. The refractory metal layer and the metal film are removed to expose the silicon containing refractory metal cone. A surface of the silicon containing refractory metal cone is subjected to an oxidation of silicon which is contained in the refractory metal. The oxidation has rates which increase toward a top portion of the silicon containing refractory metal cone, to thereby form a silicon oxide film which coats the silicon containing refractory metal cone, wherein the silicon oxide film has thickness which gradually increase toward a top portion of the silicon containing refractory metal cone. An interface between the silicon oxide film and the silicon containing refractory metal cone has sloped angles which increase toward the top portion. The silicon oxide film is removed to expose a reshaped silicon containing refractory metal cone which has a sharply pointed top. The reshaped silicon containing refractory metal cone has a surface having sloped angles which increase toward the sharply pointed top.

BRIEF DESCRIPTIONS OF THE DRAWINGS

Preferred embodiments according to the present invention will be described in detail with reference to the accompanying drawings.

DISCLOSURE OF THE INVENTION

Figure 1:
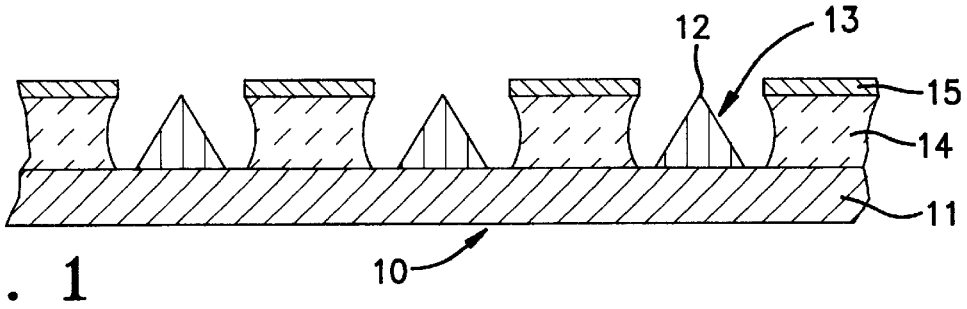
FIG. 1 is a fragmentary cross sectional elevational view illustrative of cone-shaped field emission cold cathodes aligned on a substrate.
Figure 2A:
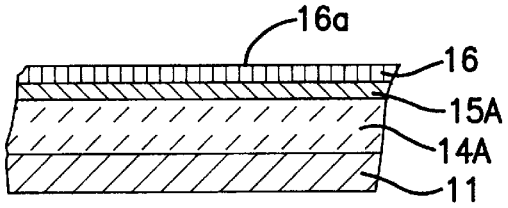
FIG. 2A PRIOR ART
FIGS. 2A through 2E are fragmentary cross sectional elevation views illustrative of sequential steps involved in the conventional method for forming a cone-shaped field emission cold cathode.
Figure 2B:
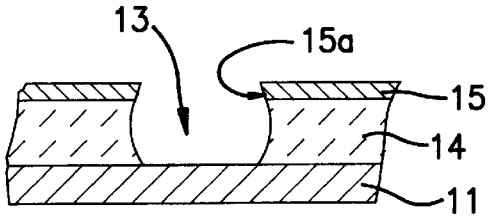
FIG. 2B PRIOR ART
Figure 2C:
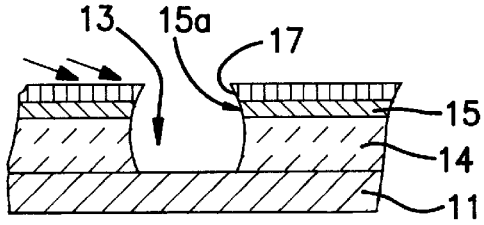
FIG. 2C PRIOR ART
Figure 2D:
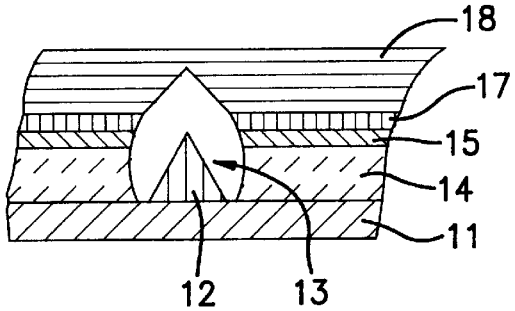
FIG. 2D PRIOR ART
Figure 2E:
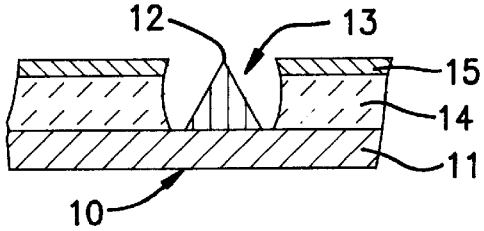
FIG. 2E PRIOR ART

The present invention provides a method for reshaping up a cone-like electrode which is made of a refractory metal containing silicon. The method comprises the following steps. A surface of the cone-like electrode is subjected to an oxidation of silicon which is contained in the refractory metal. The oxidation is generated at rates which increase toward a top portion of the cone-like electrode. As a result, a silicon oxide film is formed, which coats the cone-like electrode. The silicon oxide film has a thickness which gradually increase toward a bottom portion of the cone-like electrode. An interface between the silicon oxide film and the cone-like electrode has sloped angles which increase toward the top portion. The silicon oxide film is removed to thereby expose a reshaped cone electrode which has a sharply pointed top. The reshaped cone electrode has a surface having sloped angles which increase toward the sharply pointed top.

The refractory metal which contains silicon allows the oxidation of the surface of the cone electrode. The oxidation of the surface of the silicon containing refractory metal cone electrode is carried out to reshape the silicon containing refractory metal cone electrode. The oxidation process for reshaping the silicon containing refractory metal cone electrode results in a desired shape of the electrode having both a sharply pointed top and a surface which increase in the sloped angle toward the top portion thereof. Even if the silicon containing refractory metal cone electrode prior to the reshaping process has a small deformation, the oxidation of the surface of the silicon containing refractory metal cone electrode reshapes it, thereby resulting in the desired shape of the cone electrode having both a sharply pointed top and a surface which increase in the sloped angle toward the top portion thereof. This may result in a high yield of the field emission electron gun having the cone-shaped field emission cold cathode. The cone-shaped field emission cold cathode has a sharply pointed top portion without any variation in the shape. The cone-shaped field emission cold cathode also has a surface which is curved to increase the sloped angle toward the top portion. The top portion sharply pointed is suitable for obtaining stable and desirable electron emission.

The above oxidation of the surface of the cone-shaped field emission cold cathode for reshaping the same results in that the refractory metal content in the unoxidized part of the cone-shaped field emission cold cathode is increased and the silicon content therein is decreased. This results in the reshaped field emission cold cathode being made of the refractory metal having a lower silicon content. This refractory metal having a lower silicon content has a relatively low work function which permits the desirable electron emission properties.

The oxidation may be carried out in a dried or steamed atmosphere. The silicon oxide film may be removed by a diluted fluorine acid solution.

It is preferable that the refractory metal has a silicon content in the range of 1–10%. The refractory metal may be one selected from the group consisting of tungsten, molybdenum, tantalum and niobium.

The present invention provides a method for forming a cone-shaped field emission cold cathode on a substrate. The method comprises the following steps. A silicon oxide layer is deposited by a chemical vapor deposition on the substrate. A gate layer made of a refractory metal is deposited on the silicon oxide layer. A photo-resist pattern is provided on the gate layer. The gate layer and the silicon oxide layer are selectively etched by using the photo-resist pattern as a mask to form a cavity having an opening. A metal material is deposited on the gate layer which rotates in a plane parallel to a surface of the substrate at a predetermined oblique angle to the plane to thereby form a metal film having an opening edge which extends toward a center of the opening from an edge of the gate layer. A silicon containing refractory metal material containing silicon is deposited on the metal film and within the cavity in a vertical direction to a surface of the substrate to thereby form a silicon containing refractory metal cone in the cavity and further to form a refractory metal layer on the metal film. The refractory metal layer and the metal film are removed to expose the silicon containing refractory metal cone. A surface of the silicon containing refractory metal cone is subjected to an oxidation of silicon which is contained in the refractory metal. The oxidation has rates which increase toward a top portion of the silicon containing refractory metal cone, to thereby form a silicon oxide film which coats the silicon containing refractory metal cone, wherein the silicon oxide film has thickness which gradually increase toward a top portion of the silicon containing refractory metal cone. An interface between the silicon oxide film and the silicon containing refractory metal cone has sloped angles which increase toward the top portion. The silicon oxide film is removed to expose a reshaped silicon containing refractory metal cone which has a sharply pointed top. The reshaped silicon containing refractory metal cone has a surface having sloped angles which increase toward the sharply pointed top.

The refractory metal which contains silicon allows the oxidation of the surface of the silicon containing refractory metal cone electrode. The oxidation of the surface of the silicon containing refractory metal cone electrode is carried out to reshape the silicon containing refractory metal cone electrode. The oxidation process for reshaping the silicon containing refractory metal cone electrode results in a desired shape of the electrode having both a sharply pointed top and a surface which increase in the sloped angle toward the top portion thereof. Even if the silicon containing refractory metal cone electrode prior to the reshaping process has a small deformation, the oxidation of the surface of the silicon containing refractory metal cone electrode reshapes it, thereby resulting in the desired shape of the cone electrode having both a sharply pointed top and a surface which increase in the sloped angle toward the top portion thereof. This may result in a high yield of the field emission electron gun having the cone-shaped field emission cold cathode. The cone-shaped field emission cold cathode has a sharply pointed top portion without any variation in the shape. The cone-shaped field emission cold cathode also has a surface which is curved to increase the sloped angle toward the top portion. The top portion sharply pointed is suitable for obtaining stable and desirable electron emission.

The above oxidation of the surface of the cone-shaped field emission cold cathode for reshaping the same results in that the refractory metal content in the unoxidized part of the cone-shaped field emission cold cathode is increased and the silicon content therein is decreased. This results in the reshaped field emission cold cathode being made of the refractory metal having a lower silicon content. This refractory metal having a lower silicon content has a relatively low work function which permits the desirable electron emission properties.

The oxidation may be carried out in a dried or steamed atmosphere. The silicon oxide film may be removed by a diluted fluorine acid solution.

It is preferable that the refractory metal has a silicon content in the range of 1 to 10%. The refractory metal may be one selected from the group consisting of tungsten, molybdenum, tantalum and niobium.

Embodiment

A preferred embodiment according to the present invention will be described with reference to FIGS. 3A through 3G, wherein there is provided a novel method for forming a field emission cold cathode having a top sharply pointed without any deformation.

Figure 3A:
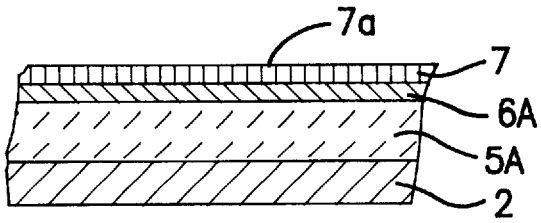
FIGS. 3A through 3G are fragmentary cross sectional elevation views illustrative of sequential steps involved in a novel method for forming a cone-shaped field emission cold cathode in a preferred embodiment according to the present invention.

With reference to FIG. 3*a,* a silicon oxide film 5A having a thickness of 1 micrometer is deposited by a chemical vapor deposition on a silicon substrate 2. A gate layer 6A having a thickness of 0.4 micrometers and being made of a refractory metal such as tungsten and molybdenum is deposited on the silicon oxide film 5A.

Figure 3B:
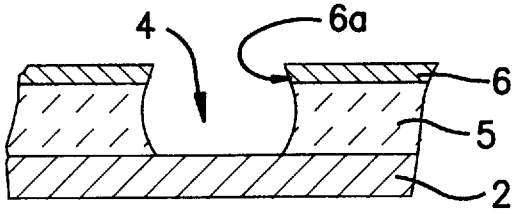
Figure 3C:
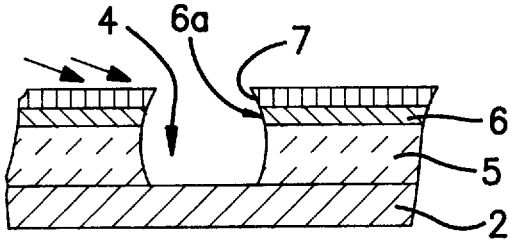
Figure 3D:
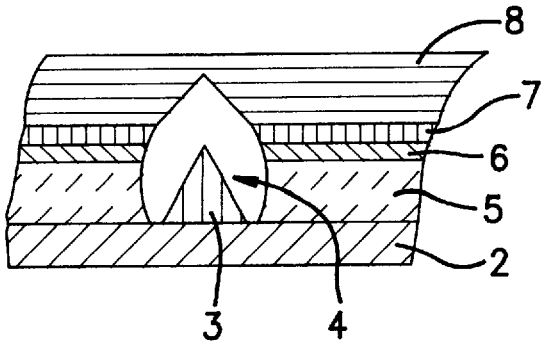

With reference to FIG. 3B, a photo-resist film is applied on the gate layer 6A. Holes having a diameter of 1 micrometer are formed at a pitch of 10 micrometers. The gate layer 6A and the silicon oxide film 5A are sequentially and selectively etched using the photo-resist film 6 having the holes as a mask to thereby form a silicon oxide film 5A which has a cavity 4 and a gate electrode 5 having an opening. The silicon substrate 2 is rotated in a plane parallel to the surface of the silicon substrate 2, during which aluminum is deposited at an oblique angle of 15 degrees to the surface of the silicon substrate 2 to thereby form an aluminum film having a thickness of 0.15 micrometers. The aluminum film has an opening edge extending toward the center of the opening from the edge of the gate electrode 5 thereby making the opening of the gate electrode 5 narrow. A refractory metal such as tungsten, molybdenum, tantalum and niobium is prepared, which contains silicon, wherein the content of silicon is in the range of 1–10%. The silicon containing refractory metal is deposited in a vertical direction to the surface of the silicon substrate 2. As a result, a silicon containing refractory metal cone 3 is formed in the cavity 4 and further a refractory metal layer 8 is deposited on the aluminum film 7. The refractory metal layer 8 has a concave portion being cone-shaped and posited over the opening of the gate electrode and over the cavity 4.

Figure 3E:
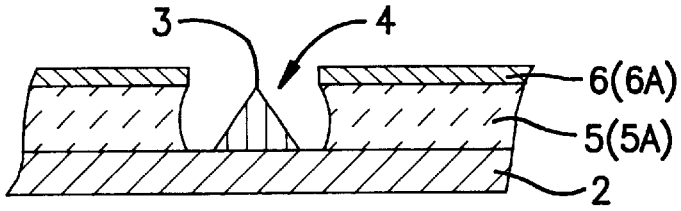

With reference to FIG. 3E, the refractory metal layer 8 and the aluminum film 7 are removed to expose the gate electrode 15 on the silicon oxide film 5 and the silicon containing refractory metal cone 3 within the cavity 4. The refractory metal cone 3 serves as a cone-shaped cathode.

Figure 3F:
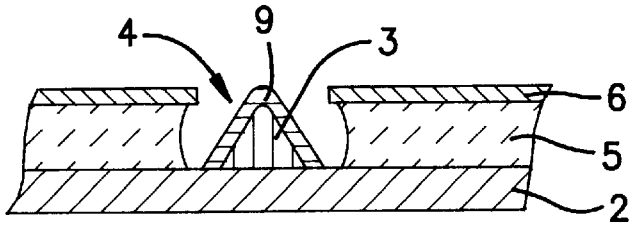

With reference to FIG. 3F, the silicon containing refractory metal cone 3 is subjected to an oxidation of silicon contained in the refractory metal cone 3 in a dried or steamed atmosphere to thereby form a silicon oxide film 9 on a surface of the silicon containing refractory metal cone 3. The rate of oxidation of the surface of the silicon containing refractory metal cone 3 is different between the top portion and the bottom portion. Since the bottom portion of the silicon containing refractory metal cone 3 has a larger volume than the top portion, the rate of the oxidation at the bottom portion is lower than the top portion. As a result, the silicon oxide film on the top portion of the silicon containing refractory metal cone 3 has a greater thickness than the bottom portion thereof. The sloped angle of the interface between the silicon oxide film 9 and the silicon containing refractory metal cone 3 increases toward the top portion thereof. The silicon oxidation increases the content of the refractory metal and decreases the silicon content.

Figure 3G:
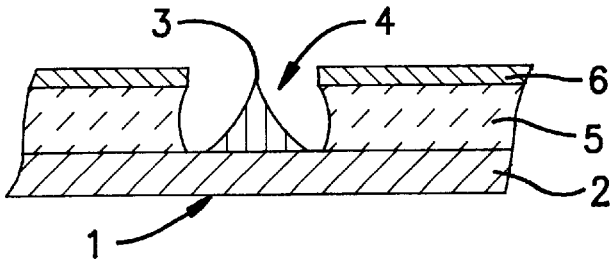

With reference to FIG. 3G, the silicon oxide film 9 is removed by using a diluted fluorine acid solution to thereby expose silicon containing refractory metal cone 3 having a reshaped surface which has a sloped angle increasing toward the top portion thereof. The top of the silicon containing refractory metal cone 3 illustrated in FIG. 3G is more sharply pointed than that illustrated in FIG. 3E.

As described above, the processes illustrated in FIGS. 3A through 3E are the same as the conventional processes illustrated in FIGS. 2A through 2E except in that the cone 3 is made of the silicon containing refractory metal. The refractory metal which contains silicon allows the oxidation of the surface of the cone in the process illustrated in FIG. 3F. The oxidation of the surface of the silicon containing refractory metal cone 3 is carried out to reshape up the silicon containing refractory metal cone 3. The oxidation process for reshaping the silicon containing refractory metal cone 3 results in a desired shape of the cathode 3 having both a sharply pointed top and the surface which increase in the sloped angle toward the top portion thereof. Even if the silicon containing refractory metal cone 3 has a small deformation, the oxidation of the surface of the silicon containing refractory metal cone 3 reshapes it, thereby resulting in the desired shape of the cathode 3 having both a sharply pointed top and a surface which increase in the sloped angle toward the top portion thereof. This may result in a high yield of the field emission electron gun having the cone-shaped field emission cold cathode. The cone-shaped field emission cold cathode has a sharply pointed top portion without any variation in the shape. The cone-shaped field emission cold cathode also has a surface which is curved to increase the sloped angle toward the top portion. The top portion sharply pointed is suitable for obtaining stable and desirable electron emission.

The above oxidation of the surface of the cone-shaped field emission cold cathode for reshaping the same results in that the refractory metal content in the unoxidized part of the cone-shaped field emission cold cathode is increased and the silicon content therein is decreased. This results in the reshaped field emission cold cathode being made of the refractory metal having a lower silicon content. This refractory metal having a lower silicon content has a relatively low work function which permits the desirable electron emission properties.

Whereas modifications of the present invention will be apparent to a person having ordinary skill in the art, to which the invention pertains, it is to be understood that embodiments shown and described by way of illustrations are by no means intended to be considered in a limiting sense. Accordingly, it is to be intended to cover by claims all modifications which fall within the spirit and scope of the invention.

What is claimed is:

1. A method for reshaping a cone-shaped electrode which is made of a refractory metal containing silicon, said method comprising:

subjecting a surface of said cone-shaped electrode to an oxidation of silicon, said oxidation having rates which increase toward a top portion of said cone-shaped electrode, to form a silicon oxide film which coats said cone-shaped electrode, said silicon oxide film having a thickness which gradually increases toward a top portion of said cone-shaped electrode, an interface between said silicon oxide film and said cone-shaped electrode having sloped angles which increase toward said top portion; and removing said silicon oxide film to expose a reshaped cone electrode which has a sharply pointed top, said reshaped cone electrode having a surface with sloped angles which increase toward said sharply pointed top.

2. The method as claimed in claim 1, wherein said oxidation is carried out in a dried atmosphere.

3. The method as claimed in claim 1, wherein said oxidation is carried out in a steamed atmosphere.

4. The method as claimed in claim 1, wherein said silicon oxide film is removed by a diluted fluorine acid solution.

5. The method as claimed in claim 1, wherein said refractory metal has a silicon content in the range of 1–10%.

6. The method as claimed in claim 1, wherein said refractory metal is one selected from the group consisting of tungsten, molybdenum, tantalum and niobium.

7. A method for forming a cone-shaped field emission cold cathode on a substrate comprising:

depositing a silicon oxide layer by a chemical vapor deposition on said substrate;

depositing a gate layer made of a refractory metal on said silicon oxide layer;

providing a photo-resist pattern on said gate layer;

selectively etching said gate layer and said silicon oxide layer by using said photo-resist pattern as a mask to form a cavity having an opening;

removing said photo-resist pattern;

depositing a metal material on said gate layer during which said substrate rotates in a plane parallel to a surface of said substrate at a predetermined oblique angle to said plane to thereby form a metal film having an opening edge which extends toward a center of said opening from an edge of said gate layer;

depositing a silicon containing refractory metal material on said metal film and within said cavity in a vertical direction to a surface of said substrate to thereby form a silicon containing refractory metal cone in said cavity and further to form a silicon containing refractory metal layer on said metal film;

removing said silicon containing refractory metal layer and said metal film to expose said silicon containing refractory metal cone;

subjecting a surface of said silicon containing refractory metal cone to an oxidation of silicon which is contained in said refractory metal, wherein said oxidation has rates which increases toward a top portion of said silicon containing refractory metal cone, to thereby form a silicon oxide film which coats said silicon containing refractory metal cone, wherein said silicon oxide film has thickness which gradually increases toward a top portion of said silicon containing refractory metal cone, and wherein an interface between said silicon oxide film and said silicon containing refractory metal cone has sloped angles which increase toward said top portion; and removing said silicon oxide film to expose a reshaped silicon containing refractory metal cone which has a sharply pointed top, said reshaped silicon containing refractory metal cone having a surface having sloped angles which increase toward said sharply pointed top.

8. The method as claimed in claim 7, wherein said oxidation is carried out in a dried atmosphere.

9. The method as claimed in claim 7, wherein said oxidation is carried out in a steamed atmosphere.

10. The method as claimed in claim 7, wherein said silicon oxide film is removed by a diluted fluorine acid solution.

11. The method as claimed in claim 7, wherein said refractory metal has a silicon content in the range of 1–10%.

12. The method as claimed in claim 7, wherein said refractory metal is one selected from the group consisting of tungsten, molybdenum, tantalum and niobium.

* * * * *